United States Patent [19]

Vallos et al.

[11] Patent Number: 4,723,689

[45] Date of Patent: Feb. 9, 1988

[54] CARTON HOLDING AND POURING DEVICE

[76] Inventors: Paul Vallos, 5 Robin Hood Road, East Ivanhoe, Victoria, 3079; Alan M. Bland, 25 Caroben Avenue, Vermont, Victoria, 3133, both of Australia

[21] Appl. No.: 878,881

[22] PCT Filed: Oct. 2, 1985

[86] PCT No.: PCT/AU85/00239

§ 371 Date: Aug. 1, 1986

§ 102(e) Date: Aug. 1, 1986

[87] PCT Pub. No.: WO86/02061

PCT Pub. Date: Apr. 10, 1986

[30] Foreign Application Priority Data

Oct. 2, 1984 [AU] Australia ..... PG7457/84

[51] Int. Cl.[4] ..... B65D 51/22

[52] U.S. Cl. ..... 222/91; 30/2; 220/85 H; 222/83; 222/183

[58] Field of Search ..... 222/80, 81, 83, 83.5, 222/85, 86, 88–91, 5, 183; 30/2, 358, 359; 229/1.5 H; 220/85 H; 141/19, 329

[56] References Cited

U.S. PATENT DOCUMENTS

| | | | |
|---|---|---|---|
| 2,003,562 | 6/1935 | Stuart | 222/91 X |
| 2,028,175 | 1/1936 | Waite | 222/83 |
| 2,262,812 | 11/1941 | Morehouse | 222/88 X |
| 2,266,570 | 12/1941 | Searls | 222/88 |
| 2,438,299 | 3/1948 | Relis | 222/91 X |
| 2,535,783 | 12/1950 | Churchill et al. | 222/86 |
| 2,556,311 | 6/1951 | Winkler | 222/86 |
| 2,663,460 | 12/1953 | Keeney | 222/86 |
| 3,285,472 | 11/1966 | Olson | 222/86 |
| 3,587,928 | 6/1971 | Charmel | 222/91 |
| 3,768,698 | 10/1973 | Corty, Sr. et al. | 222/91 |
| 3,922,099 | 11/1975 | Christine et al. | 222/91 X |
| 4,150,768 | 4/1979 | Maynard, Jr. | 222/89 |
| 4,202,469 | 5/1980 | Brandt | 222/91 |
| 4,247,020 | 1/1981 | Desjardins | 222/88 X |
| 4,475,670 | 10/1984 | Rutter | 222/91 X |

FOREIGN PATENT DOCUMENTS

| | | | |
|---|---|---|---|
| 503023 | 8/1979 | Australia . | |
| 596719 | 4/1960 | Canada | 229/1.5 H |
| 2704383 | 8/1978 | Fed. Rep. of Germany . | |
| 916878 | 12/1918 | France . | |
| 482050 | 3/1938 | United Kingdom . | |
| 2135288A | 8/1984 | United Kingdom . | |

OTHER PUBLICATIONS

International Search Report, PCT/AU85/00239, 10/2/85.

*Primary Examiner*—F. J. Bartuska
*Assistant Examiner*—Kevin P. Shaver
*Attorney, Agent, or Firm*—Sughrue, Mion, Zinn, Macpeak and Seas

[57] ABSTRACT

A holder for a liquid-containing carton, for example a milk carton, comprises a body adapted to fit over the top of the carton, the body having resiliently-mounted abutments which snap into engagement beneath exposed edges of a top closure of the carton. A pouring spout is rotatably mounted on the body and includes a blade which cuts a circular pouring opening in the closure upon rotation of the spout, the spout being sealed with in the opening. The body includes a handle by which the carton can be carried and tipped to dispense the contents.

7 Claims, 7 Drawing Figures

CARTON HOLDING AND POURING DEVICE

The present invention relates to carton holders.

Substantial quantities of milk, fruit juices and other drinks are now sold in cartons of waxed board, typically of 1 liter or 2 liter capacity. Conventionally, such cartons are of design which permits the carton to be opened at the top to form a pouring spout from part of the top closure. Although the actions necessary to open the carton are relatively simple, the opening procedure is not always fully successful and this may result in malformation of the spout. In addition, the cartons are sometimes a little difficult to handle due to condensation on their external surfaces with the result that the carton can slip in the hand and also children and others with small hands have difficulty in holding the cartons, particularly cartons of 2 liter capacity.

A requirement accordingly exists for a holder which permits a carton to be held more easily, and also which facilitates opening of the carton.

According to the present invention, there is provided a holder for a carton containing liquid, said holder comprising a body engageable over the top of the carton, a pouring spout carried by the body, means for cutting a pouring opening in the top of the carton to enable an inner end portion of the spout to be received within the opening, means for providing a seal between the inner end portion of the spout and the opening, and a handle for lifting and tipping the body for discharge of the liquid through the spout.

Preferably, the pouring spout is rotatably mounted on the body and includes a cutter adapted to cut a circular pouring opening in the carton upon rotation of the spout.

Preferably, the holder includes at least one resiliently-mounted abutment adapted to snap into engagement beneath an exposed edge of a top closure of the carton, said abutment being releasable to permit removal of the carton from the holder.

Embodiments of the invention will now be described by way of example only with reference to the accompanying drawings, in which.

Figure 4:
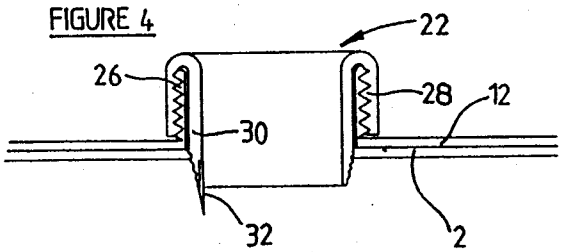
FIG. 4 is a section through a pouring spout.
Figure 1:
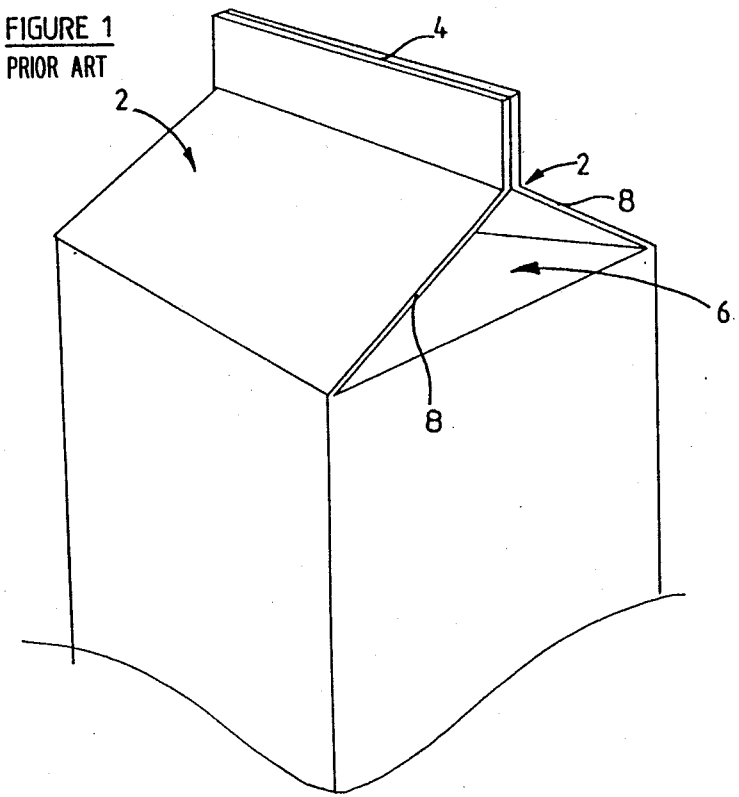
FIGURE 1 PRIOR ART
FIG. 1 is a perspective view of the top part of a conventional carton with which the holder of an embodiment of the invention is intended for use.

The carton holder of the embodiments to be described is designed for use with a rectangular carton of conventional form comprising, as shown in FIG. 1, a top closure of gable-like construction with two opposed, inclined, side walls 2 which meet at an apex and are sealed together to form a substantially vertical fin 4. Opposed end walls of the closure are folded inwardly beneath the inclined side walls of the closure whereby a triangular recess 6 is formed at each end of the closure beneath the end edges 8 of the two inclined side walls 2.

Figure 2:
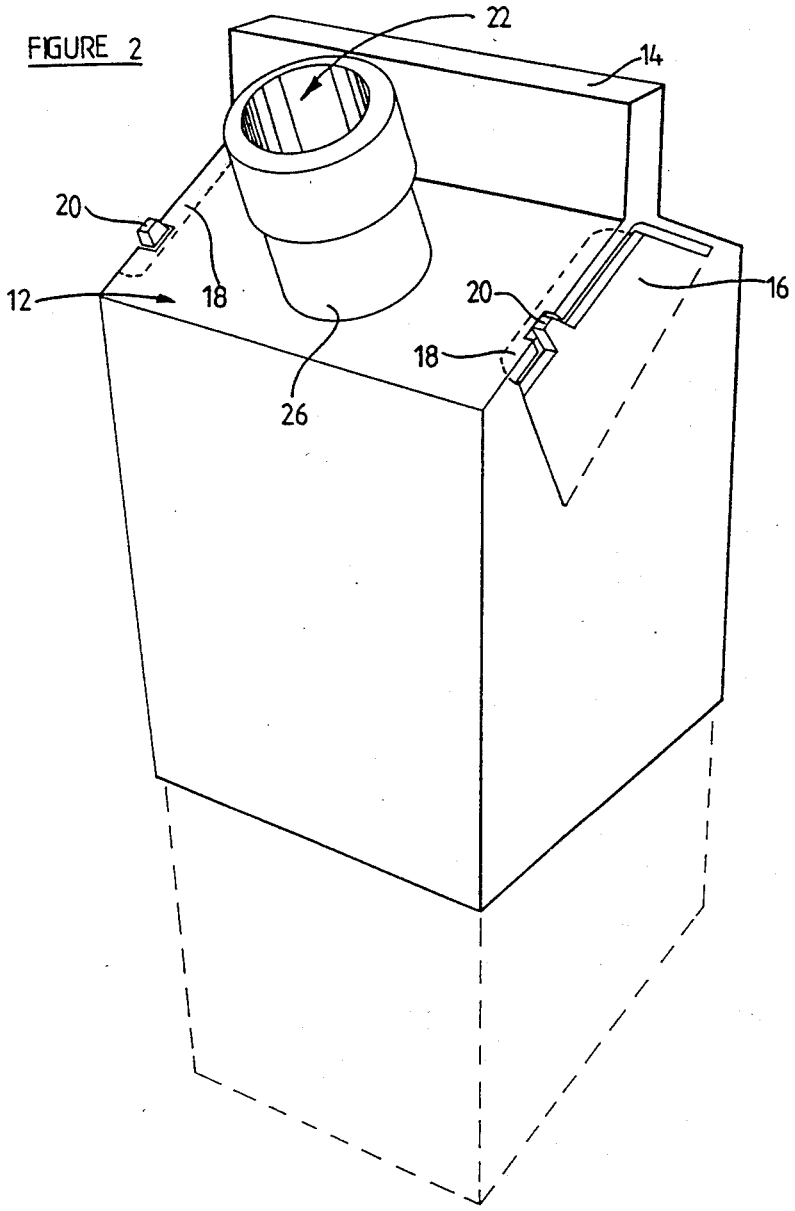
FIG. 2 is a front perspective view showing the holder of one embodiment of the invention in position on a carton.
Figure 3:
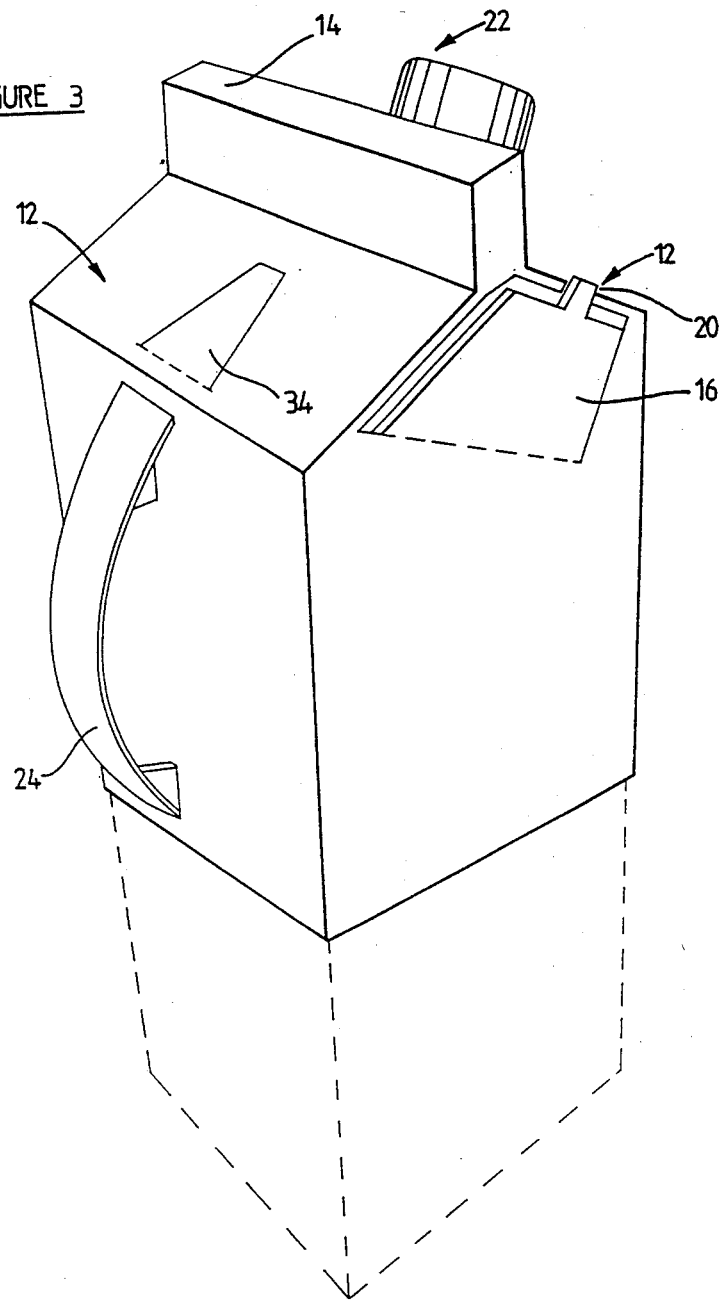
FIG. 3 is a rear perspective view of the holder in position on the carton.

The holder shown in FIGS. 2 and 3 is open-bottomed so as to fit over the top of the carton, with the main body of the holder extending part way down the body of the carton, the main body of the holder being of a cross-sectional size such that it fits closely, but not tightly, on the body of the carton. At its upper end, the holder has two inclined walls 12 adapted to lie flush against the inclined walls 2 of the carton closure, and a downwardly-open central channel 14 adapted to receive the vertical fin 4. A resilient flap 16 lies adjacent each of the two triangular recesses 6 in the end wall of the carton, each flap 16 having an inwardly-directed abutment 18 which snaps into engagement beneath the end edge 8 of one of the two inclined walls of the carton closure when the holder is fitted into position over the top of the carton. When so engaged, the abutments 18 prevent the carton from falling downwardly out of the holder. Preferably, each abutment 18 is in the form of a lip extending along the underside of the end edge 8 of the inclined wall of the carton closure. In order to release the abutments 18 from engagement beneath the end edges 8 so as to permit removal of the carton from the holder, each flap 16 is provided with a projecting tongue 20 which enables the flap 16 to be flexed outwardly by manual pressure.

A pouring spout 22, which will be described in detail shortly, is carried by one of the two inclined upper walls 12 of the holder and a handle 24 by which the holder and carton may be carried and tipped to dispense the contents through the spout 22 is provided on the main body of the holder at the opposite side to the spout 22, and beneath the level of the spout 22.

The pouring spout 22 is mounted on a tubular spigot 26 projecting outwardly from the inclined upper wall 12, the spigot 26 being threaded on its external surface. A spout 22 has an internally-threaded skirt 28 adapted to be screwed around the outside of the spigot 26 and an inner sleeve 30 which fits within the spigot 26. The inner end of the sleeve 30 carries an axially-projecting blade 32, the inner end of the sleeve 30 being formed on its external surface with a fine screw thread or a series of closely spaced annular ribs. When the holder is placed in position on the carton, the carton may be opened by screwing the spout 22 onto the spigot 26. This action causes the blade 32 at the end of the sleeve 30 to cut a circular hole out of the inclined wall 2 of the carton closure, with the inner end of the sleeve 30 projecting into the interior of the carton through the hole. The diameter of the hole cut by the blade 32 is slightly less than the external diameter of the sleeve 30 whereby the sleeve 30 is a tight fit within the hole and the edge portion of the board around the hole engages with the groove formed by fine thread or ribs on the external surface of the sleeve 30 so as to form a liquid-tight seal. Preferably, the co-operating thread between the spigot 26 and the skirt 28 of the spout 22 is such that the spout 22 is able to be screwed into position in about 1½ turns. The outer annular edge of the spout 22 is shaped in order to facilitate pouring.

In order to prepare a full carton for use, the holder is placed over the top of the carton until the top of the carton seats within the top of the holder, with the abutments 18 on the resilient flaps 16 located beneath the end edges 8 of the inclined walls 2 of the carton closure. The spout 22 is then screwed onto the spigot 26 in order to cut the opening in one of the inclined walls 2 and to locate the inner end portion of the sleeve 30 as a sealed fit within the opening. The carton is now ready for use for discharge of the contents through the spout 22. Preferably, the spout 22 is provided with a removable lid or plug (not shown) to permit the spout 22 to be closed when required.

When the carton is empty, the carton is removed from the holder by unscrewing the spout 22 from the spigot 26 and then releasing the abutments 18 from beneath the end edges 8 of the inclined walls of the container closure. The abutments 18 are released by pushing the two resilient flaps apart using the tongues 20, and this may be simply done by the thumb and forefinger of one hand, while the handle 24 of the holder is held in the the other hand. The carton is then free to drop from the holder and preferably, this action is assisted by applying finger pressure to the top of the carton either via a resilient tongue 34 which overlies the carton closure adjacent the top of the handle, or (as is preferred) through a hole formed in the holder in a similar position. When such a hole is provided, the hole also provides a zone through which the carton can be pierced to provide an air hole to assist dispensing of the liquid. A suitable piercing tool may be incorporated into the removable lid or plug for the spout.

The holder, with the resilient flaps 16, spigot 26 and handle 24 is preferably formed as an integral moulding in plastics.

The spout 22 may be spring-mounted on the spigot 26 so that when the thread on the skirt 28 is released from the thread on the spigot 26, the spout 22 is biased outwardly to ensure that the blade 32 is retracted within the spigot 26.

Figure 5:
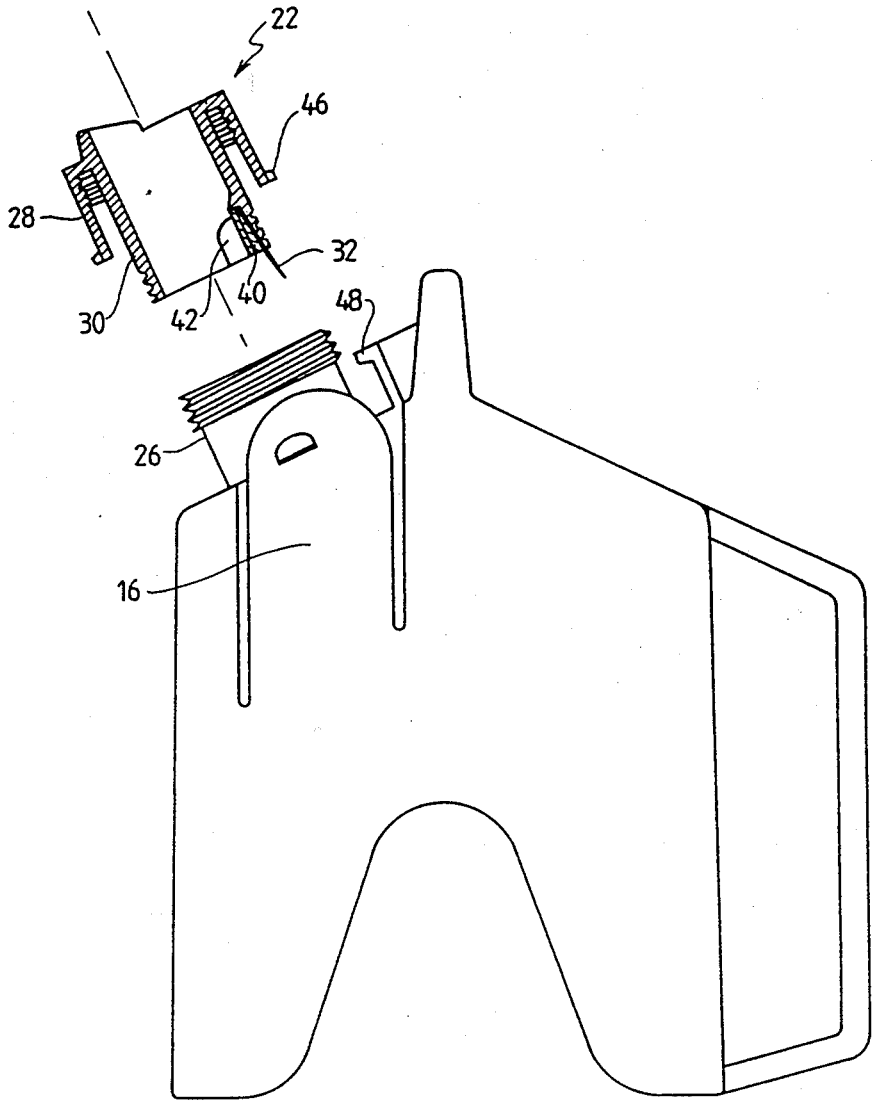
FIG. 5 is a side elevation of a modified embodiment of the holder.
Figure 6:
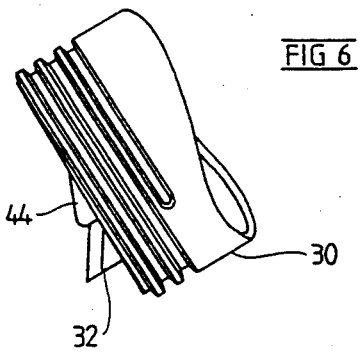
FIG. 6 is a fragmentary side elevation of an inner end of a pouring spout of the holder of FIG. 5.
Figure 7:
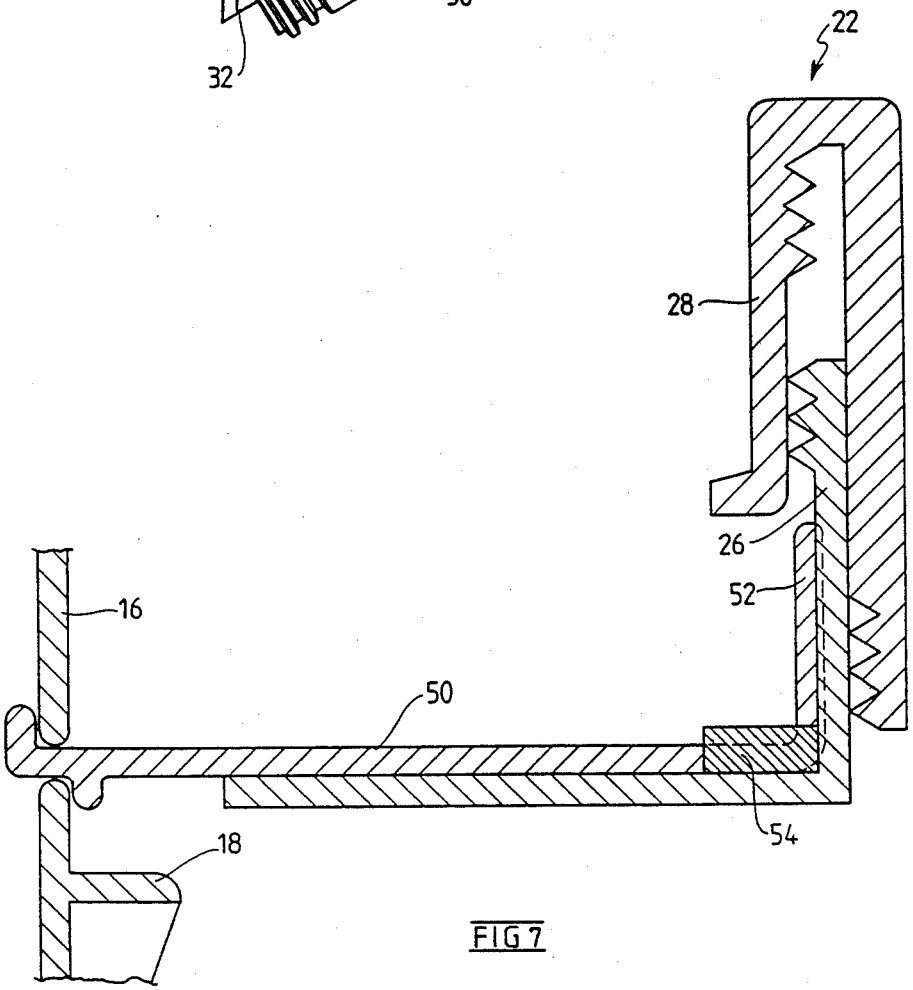
FIG. 7 is a fragmentary section through the upper part of the holder of FIG. 5.

In the modified embodiment as shown in FIGS. 5 to 7, to facilitate mounting of the blade 32 on the inner sleeve 30 of the spout 22 during manufacture, the inner sleeve 30 is moulded with a groove in its inner surface to receive an insert 40 which carries the blade 32, the groove preferably being of dovetail or other undercut section and opening onto the lower end edge of the sleeve 30 to enable the insert and blade to be inserted from below. The insert is of corresponding section, and both the groove and insert may taper in an upwards direction whereby the insert is wedged within the groove, the insert subsequently being permanently fixed within the groove, for example by ultrasonic welding. The insert 40 may include a fin 42 which projects into the interior of the sleeve 30 behind the blade 32 to act as a guard to prevent or inhibit contact of the blade by fingers (particularly children's fingers) inserted into the spout 22 when in position on the carton.

In order to prevent the circular disc cut by the blade 32 out of the inclined wall 2 of the carton closure from falling into the carton when the hole is formed, means are provided to ensure that the disc remains attached to the carton along a small arc, preferably at the top of the disc so that the disc hangs downwardly without restricting the flow through the spout during pouring. This effect may be achieved by means of a nose or other protuberance 44 (FIG. 6) projecting axially from the lower end of the sleeve 30 so that the nose lies immediately in front of the blade 32 in the direction of rotation of the spout to cut the opening. The nose 44 engages the disc during cutting and the axial inwards movement of the nose 44 during rotation of the spout 22 due to the co-action between the screw threads on the spout 22 and spigot 26 causes the disc to be pushed progressively inwardly whereby when the blade 32 has completed a 360° arc it does not engage the beginning of the original cut, but instead starts to cut the disc radially inwardly of the original cut so that the disc remains attached to the carton even though the blade 32 has traversed through more than 360° .

To ensure that the point of attachment is substantially at the top of the disc, it is necessary for cutting to commence substantially at the top of the disc. In order to provide for the correct angular positioning for the spout 22 (and thus for the blade 32) at the start of cutting to achieve this effect, the skirt 28 of the spout is formed at its lower end with an outwardly-directed annular flange 46 which includes a radial slot adapted to co-operate with a locating fin 48 on the body of the holder. The fin 48 is so positioned that the spout 22 cannot be moved downwardly to engage the thread on the skirt 28 with the thread on the spigot 26 unless the fin 48 is aligned with the slot to enable the fin 48 to pass through the slot, the relative angular positions of the spout 22 and fin 48 in which this happens being such as to correspond with the beginning of the threads, to the position the blade 32 substantially at the top of the disc to be cut.

To ensure that, after use, the spout 22 is fully unscrewed from the spigot 26 whereby prior to removal of the empty carton so that the annular flange 46 of the spout 22 is above the locating fin whereby opening of a fresh carton requires the correct angular location of the spout 22 as described above, and also the blade 32 is shielded within the spout, the two resilient flaps 16 which engage the holder with the carton are restrained against an outwards release movement until the spout 22 has been fully unscrewed. This is achieved by means of sliding links 50 (FIG. 7) each engaged with a respective one of the flaps 16 and extending inwardly along the top of the holder to terminate in raised portions 52 which project upwardly along the external surface of the spigot 26. When the spout 22 is threadedly engaged with the spigot 26 the portions 52 of the links 50 are trapped between the spigot 26 and the skirt 28. The sliding links 50 are constrained by guides 54 for movement in directions at right angles to the flaps 16 and prevent outwards movement of the flaps 16, and thus release of the carton until the spout 22 has been fully unscrewed with the skirt 28 clear of the raised portions 52.

The embodiments have been described by way of example only and modifications are possible within the scope of the invention disclosed.

We claim:

1. A holder for a carton containing liquid, said holder comprising a body engageable over the top of the carton, said body including a handle, a pouring spout rotatably carried by the body, said spout including a tubular portion and a blade projecting from an inner end of the tubular portion and operative on rotation of the spout to cut a circular opening in the carton into which the spout projects as a sealing fit, the improvement comprising means for causing the blade to produce a spiral cut in the carton whereby a disc cut out by the blade remains attached to the carton.

2. A holder according to claim 1, wherein the blade is threadedly mounted relative to the body and the means for causing the blade to produce a spiral cut comprises a projection on the tubular portion in advance of the blade to push the disc progressively inwardly during rotation of the spout.

3. A holder for a carton containing a liquid, comprising a body engagable over the top of the carton, a pouring spout carried by the body and a handle for lifting and tipping the body for discharge of the liquid through the spout, wherein the body includes a tubular spigot and the spout is threadedly mounted on the spigot and comprises a tubular portion projecting through the spigot, said tubular portion carrying a blade for cutting a pouring opening in the carton upon rotation of the spout relative to the spigot, the threaded mounting of the spout on the spigot also causing the spout to move axially towards the interior of the body during such rotation, and the tubular portion of the spout including a projection in advance of the blade in the direction of rotation to engage the material of the carton defined within the opening being cut so as to push such material progressively inwardly during cutting, and means for providing a seal between the tubular portion of the spout and the opening to prevent leakage around the spout.

4. A holder according to claim 3, further comprising means for angularly locating the spout at the commencement of cutting the pouring opening whereby cutting commences at a predetermined position.

5. A holder according to claim 3, further comprising at least one resilently-mounted abutment adapted to snap into engagement beneath an exposed edge of a top closure of the carton, said abutment being releasable to permit removal of the carton from the holder.

6. A holder according to claim 3, wherein the means for providing a seal comprises at least one circumferential groove in the tubular portion to receive the portion of the carton surrounding the opening.

7. A holder for a carton containing liquid wherein the carton has a top closure with opposed exposed edges, said holder comprising a body having side walls and an upper wall, said body being open at its lower end whereby the holder is engagable over the top of the carton with the upper wall of the body lying adjacent the top closure of the carton, a handle for holding the body, resilient abutments at opposite sides of the upper wall of the body, said abutments being biased to snap into engagement beneath the respective exposed edges of the closure when the upper wall of the body is adjacent the top closure whereby to secure the holder to the carton, a pouring spout mounted on the upper wall of the body, said spout having a tubular body portion with means operable to form an opening in said carton and into which an inner end of the tubular body portion is received as a tight sealing fit, a tongue for releasing each respective abutment, said tongues projecting beyond at opposite sides of the upper wall and said tongues being movable apart by finger pressure to release said abutments, and means in the upper wall of the holder adjacent the handle enabling application of manual pressure to the top closure of the carton to push the carton downwardly from the holder after release of the abutments.

* * * * *